United States Patent [19]

Perrin

[11] 4,013,236

[45] Mar. 22, 1977

[54] AUTOMATIC DISMOUNTING ROLL FOR ROLL TOWEL DISPENSERS

[75] Inventor: Jack Louis Perrin, Los Angeles, Calif.

[73] Assignee: Towlsaver, Inc., Los Angeles, Calif.

[22] Filed: Mar. 11, 1976

[21] Appl. No.: 665,896

[52] U.S. Cl. ..... 242/1; 206/389; 242/55.2

[51] Int. Cl.[2] ..... A47K 10/16; A47K 10/22; A47K 10/32

[58] Field of Search ..... 242/55.2, 55.53, 55.3, 242/55.55, 1, 68.5, 55, 68.4, 398; 312/39; 206/389

[56] References Cited

UNITED STATES PATENTS

| | | | |
|---|---|---|---|
| 2,380,644 | 7/1945 | Grondona | 242/55.2 |
| 2,726,823 | 12/1955 | Jespersen | 242/55.53 |
| 3,010,669 | 11/1961 | Layton | 242/68.4 X |
| 3,038,598 | 6/1962 | Layton et al. | 242/1 |
| R25,828 | 8/1965 | Wooster | 242/55.2 |

*Primary Examiner*—George F. Mautz
*Attorney, Agent, or Firm*—Mahoney, Schick & Cislo

[57] ABSTRACT

A continuously wound strip of toweling, either solid wound or wound about a hollow central core, forms the roll with radial end surfaces. A pair of diametrically aligned, axial pin openings are formed in one of the roll end surfaces equally radially spaced from the central longitudinal axis with radially inner extremities radially outwardly of any roll core. If the roll is solid wound, a central axial opening is formed in the other roll end surface preferably semi-spherical in shape or if the roll is hollow core wound, the core forms the central axial opening at the other roll end surface. In either case, with dispenser pin support and central support at the opposite roll ends, dispensing unwinding of the strip of toweling to the pin hole radially inner extremities releases the roll for endwise pivoting about the other roll end automatically dismounting the same. In addition to the central opening at the other roll end surface, a circumferential groove may be formed therein radially outwardly of the central opening to adapt the roll for versatile use with known dispenser dismounting structures.

17 Claims, 4 Drawing Figures

AUTOMATIC DISMOUNTING ROLL FOR ROLL TOWEL DISPENSERS

BACKGROUND OF THE INVENTION

This invention relates to an automatic dismounting roll for roll towel dispensers and more particularly, to such a roll specifically adapted for use with a greatly simplified dispenser automatic roll dismounting structure. With the unique automatic dismounting roll of the present invention, not only is the roll adapted for secure support during the dispensing operations and likewise adapted for positive and efficient automatic dismounting of the same, but the roll also lends itself to greatly simplified manufacturing procedures so as to reduce production costs over those required for prior automatic dismounting roll constructions. As a subsidiary advantage of the simplified automatic dismounting roll of the present invention, other elements of structure may be added thereto for supplying versatility in use of the roll in known prior automatic roll dismounting dispensers.

Various prior roll towel dispenser structures have heretofore been provided, some of which have included automatic roll dismounting after a predicted amount of the toweling has been dispensed from the particular roll. In general, most of the prior dispensers are hollow box-like in configuration adapted for being wall mounted on a vertical wall surface and are usually selectively front opening for providing access to the interior of the dispenser cabinet in order to perform the toweling roll replacement operations. Furthermore, since this class of dispensers make use of rolls of toweling, the toweling is dispensed in continuous strip form downwardly from the dispenser during the operation thereof.

More particularly, the roll of toweling is rotatably supported within the dispenser with the main longitudinal axis thereof between roll end holders. The continuous strip of toweling is fed downwardly from the roll between a pair of rotatable dispensing rolls and from the dispensing rolls downwardly adjacent a cutting bar and from the dispenser. The roll of toweling is supported freely rotatable so that, upon selective rotation of the dispensing rolls by means of one of various forms of hand operating levers, the strip of toweling is dispensed from the cabinet and ultimately severed against the cutting bar after a quantity thereof is so dispensed.

In automatic roll dismounting dispensers, the particular roll of toweling from which the strip of toweling is being dispensed is supported on the roll end holders so that once a given quantity of toweling has been unrolled and dispensed therefrom, the roll end holders, usually through a cooperative specific roll formation, physically release the roll and permit the same to drop downwardly within the cabinet into a particularly provided used roll recess. Since the strip of toweling being dispensed from the roll is still firmly retained between the selectively rotatable dispensing rolls despite the fact that the roll is now resting in this used roll recess of the cabinet, following rotation of the dispensing rolls for the dispensing operation will continue to draw the strip of toweling from the roll while the roll now slideably rotates within this recess, and there will be no interruption of a limited number of further dispensing operations. However, since the roll from which the strip of toweling is being dispensed is now displaced from the roll end holders, a fresh roll of toweling can be mounted between the roll end holders during a maintenance operation, the strip of toweling from the fresh roll positioned directed downwardly between the dispensing rolls simultaneously with the strip of toweling from the used roll and the strip of toweling from both the used and fresh rolls will be automatically dispensed simultaneously from the dispenser until the used roll is completely exhausted of toweling.

Basically, the most common manner of providing an automatic roll dismounting dispenser is to form the roll end holders with a specific cooperable roll formation so that retention of the roll of toweling by the roll end holders at least at one end of the roll is determined by the layers of toweling on the roll. In other words, the roll end holder and roll are cooperably formed such that the roll will be supported by the roll end holder properly rotatable for dispensing until a given number of layers of the toweling have been rotatably wound therefrom, at which time, a portion of the roll end holder is automatically exposed to automatically remove the roll support of that particular roll end holder and the roll thereby is automatically released through gravity to pivot endwise about the other roll end holder ultimately falling downwardly to come to rest within the dispenser used roll recess as hereinbefore described. It is the rolls of toweling used by this general form of automatic roll dismounting dispensers to which the improvements of the present invention are directed.

OBJECTS AND SUMMARY OF THE INVENTION

It is, therefore, an object of this invention to provide an automatic dismounting roll for roll towel dispensers which is adapted for highly secure rotatable support in a dispenser during the normal dispensing operations of a strip of toweling therefrom, yet is also adapted for efficient and positive automatic dismounting after a predicted amount of the strip of toweling has been thusly dispensed. According to the preferred embodiment principles of the present invention, one of the roll end surfaces has diametrically opposite pin holes formed axially therein equally radially spaced from the main longitudinal axis of the roll and radially outwardly of any roll core, and the other end surface of the roll merely requires structure adapted for central roll support. For instance, if the toweling roll is of solid wound strip, the central support for the other roll end surface may merely be a central axial hole or opening and if the roll includes a central core, the central support at the other roll end surface may be in the core end such as the opening of a hollow core. In any case, with the roll dispenser supported by appropriate pins in the pin holes and a central support in the central support hole or opening, unwinding of the strip of toweling during dispensing to the pin hole radially inner extremities will release the one end of the roll to pivot endwise about the other end central support, thereby efficiently dismounting the same.

It is another object of this invention to provide an automatic dismounting roll for roll towel dispensers of the foregoing general structure and advantages which, due to the extreme simplicity of the roll support and dismounting concept, may be manufactured and supplied for a minimum of additional cost over rolls of toweling not including the automatic dismounting feature and at a manufacturing cost less than prior automatic dismounting rolls of toweling. With a core wound roll of toweling, the only required added structure over the usual standard roll of toweling is the pin holes at the one roll end surface, and if the roll is solid wound without a core, only the central opening at the other roll end surface need be added to the pin openings. Thus, the cost of manufacture of the unique automatic dismounting roll of the present invention over standard rolls of toweling is quite nominal despite the automatic dismounting advantages added thereto.

It is still a further object of this invention to provide an automatic dismounting roll for roll towel dispensers satisfying the foregoing objects, while still being perfectly adaptable to the inclusion in the structure of an additional element or elements supplying versatility for alternate use of the same roll of toweling with certain prior roll towel dispensers having a different form of automatic dismounting roll. Using the exact above discussed toweling roll structure to supply a roll incorporating the unique features of the present invention, a circumferential groove may be formed in the other roll end surface spaced radially outwardly of the central hole or opening thereof capable of the reception of a circumferential axial blade or projection therein as used in certain prior automatic dismounting roll mechanisms. The result is that rolls of toweling constructed in this manner will then be perfectly usable in dispensers adapted for satisfying the unique principles of the present invention, yet at the same time, usable in the prior constructions of dispensers for providing the old form of roll automatic dismounting in such dispensers.

Other objects and advantages of the invention will be apparent from the following specification and the accompanying drawings which are for the purpose of illustration only.

DESCRIPTION OF THE BEST EMBODIMENTS CONTEMPLATED

Figure 1:
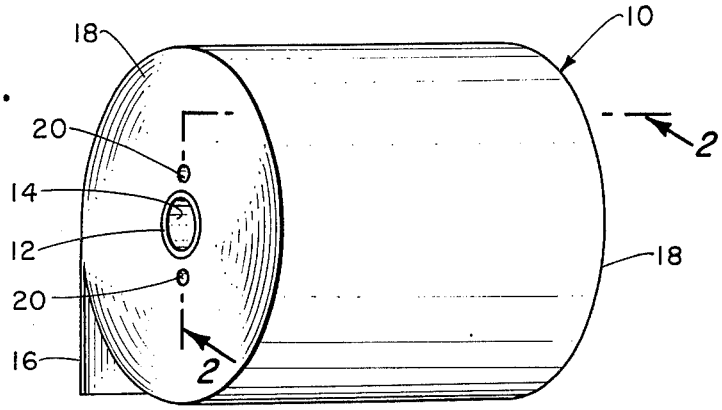
FIG. 1 is a perspective view of a roll of core wound, strip toweling according to a preferred embodiment of the automatic dismounting roll principles of the present invention.
Figure 2:
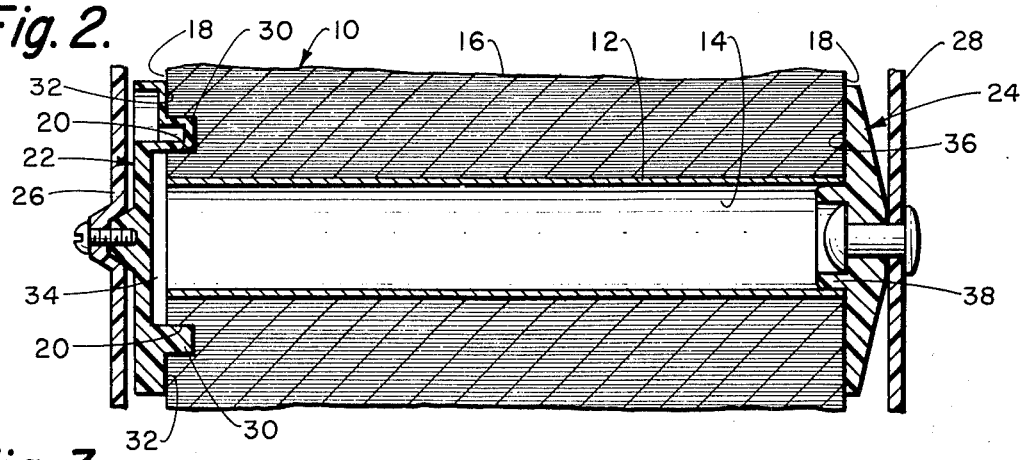
FIG. 2 is an enlarged, fragmentary, vertical sectional view of the roll of toweling of FIG. 1 with the roll of toweling mounted in dispensing position in an illustrative dispenser.

Referring to FIGS. 1 and 2 of the drawings, a somewhat standard roll of hollow core wound, strip toweling is generally indicated at 10 incorporating a preferred first embodiment of the automatic dismounting roll principles of the present invention. As in standard rolls of toweling, a hollow, cylindrical core 12 having an axial, central opening or hole 14 may be formed of relatively stiff or rigid cardboard or other material and has a single-ply or multi-ply, continuous strip of toweling 16 wound circumferentially thereabout to provide the roll 10. The central longitudinal axis of the core 12 thereby forms the central or main longitudinal axis of the roll 10 and the combination of the ends of the core with the wound strip of toweling 16 form radially extending, opposite roll end surfaces 18 for the roll 10.

More particularly according to the principles of the present invention, one of the roll end surfaces 18 of the roll 10 is formed with a pair of preferably substantially identical, diametrically opposite, axial pin holes or openings 20. The pin holes 20 are equally radially spaced from the main longitudinal axis of the roll 10 and are located radially outwardly of any core so as to be radially outwardly of the core 12. Thus, in the preferred embodiment shown, the pin holes 20 are cylindrical, axial holes having radially inner extremities spaced radially outwardly of the core 12 within the wound strip of towelling 16, the radially inner extremities of the pin holes 20 thereby being likewise equally radially spaced from the main longitudinal axis of the roll 10. The other roll end surface 18 of this first embodiment roll 10 does not require any modification from a standard roll.

In formation of this first embodiment roll of toweling 10, the core 12 is first wound with the strip of toweling 16 in usual well known manner to essentially form, at this stage, a standard roll of toweling. The pin holes 20 are then formed in the individual rolls of toweling 10, that is, in the wound strip of toweling 16 thereof, by drilling or other well known cutting operations and precisely located as described. For instance, the pin holes 20 may be precisely formed in the roll 10 on a high speed modern production basis using machines with usual precision jigs or the like so as to reduce production time and expense to a minimum for this relatively simple, although precise, operation.

This first embodiment roll of toweling 10 is, therefore, adapted for use in a standard roll towel dispenser (not shown) only modified at first and second roll end holders generally indicated at 22 and 24, respectively, otherwise the dispenser may be of standard automatic dismounting roll type. As shown in FIG. 2 in a preferred modified form, the first roll end holder 22 is rotatably secured on a dispenser mounting member 26 and the second roll end holder 24 is rotatably secured on a dispenser mounting member 28, the two roll end holders, of course, being rotatably axially aligned in roll dispensing position. One or the other of the first and second roll end holders 22 or 24 with its particular mounting member 26 or 28 is preferably positioned in the dispenser selectively movable hingedly or otherwise generally axially toward and away from its particular roll mounting position to permit the mounting of the rolls of toweling 10 in the dispenser.

The first roll end holder 22 includes diametrically opposite, axial cylindrical pins 30 precisely located and sized for reception in the pin holes 20 of the roll of toweling 10 to securely retain the roll rotatable about its main longitudinal axis. Equally spaced axially from its axial extremity, each of the pins 30 has a radial abutment surface 32 formed on the first roll end holder 22 extending tangentially adjacent the pin radially inner extremities and circumferentially around the pins radially outwardly thereof. These radial abutment surfaces 32, thereby, define a recess 34 in the first roll end holder 22 beginning at the radially inner extremities of the pins 30 and extending radially between the pins. The second roll end holder 24 includes radial, annular abutment surfaces 36 surrounding an axial, cylindrical, central core engagement member 38 sized for reception in the core opening 14 and thereby having radial extremities spaced inwardly from the radially inner extremities of the first holder pins 30 and the roll pin holes 20.

The first embodiment roll of toweling 10 may, therefore, be rotatably mounted by the first and second roll end holders 22 and 24 with the first holder pins 30 received in the pin holes 20 at the one roll end surface 18 and the second holder engagement member 38 received in the opening 14 of the core 12 at the other roll end surface 18. As so positioned, the abutment surfaces 32 and 36 of the first and second roll end holders 22 and 24 axially abut the roll end surfaces 18 of the roll 10 so that these combined elements securely retain the roll of toweling for rotating dispensing of the strip of toweling 16 therefrom. Furthermore, upon the strip of toweling 16 being unrolled from the roll 10 during dispensing completely uncovering the first holder pins 30 so as to substantially eliminate the pin holes 20 and reach the pin hole radially inner extremities, holding of that end of the roll 10 is eliminated so that the roll will endwise pivot about the second roll end holder 24 pivoting through the clearance provided by the recess 34 of the first roll end holder 22 and ultimately completely disengage free of the first and second roll end holders to complete the automatic dismounting operation.

Figure 3:
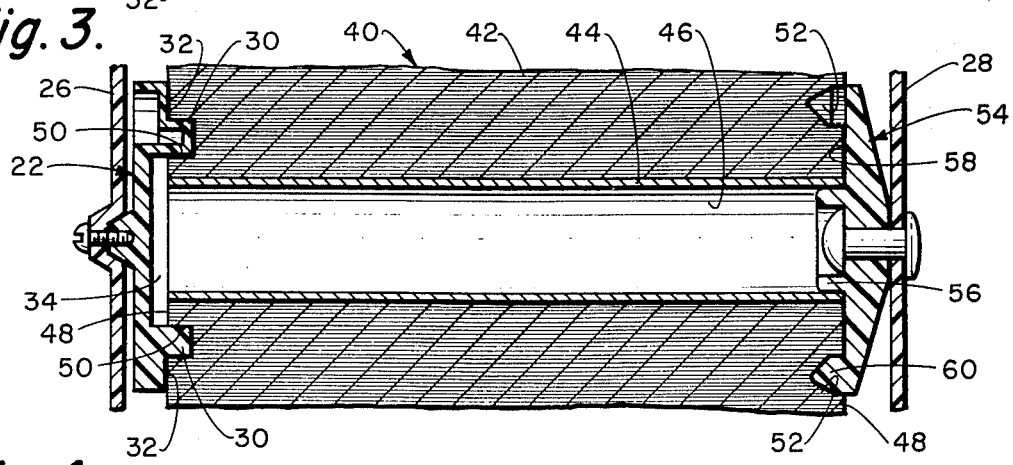
FIG. 3 is a view similar to FIG. 2, but showing a second embodiment form of a roll of toweling incorporating certain of the principles of the present invention.

Referring to FIG. 3, the preferred second embodiment of the automatic dismounting roll of the present invention is essentially the same as the first embodiment form above described with the addition of one element of structure. The roll of toweling generally indicated at 40 is again a continuously wound strip of toweling 42 wound about a central core 44 having the central opening or hole 46. Radial roll end surfaces 48 are thereby formed and diametrically opposite, axial pin holes 50 are similarly formed in the one roll end surface precisely located in the roll 40 and relative to the core 44 as before.

The other roll end surface 48 of this second embodiment form, however, includes the addition of an annular, circumferentially extending groove 52 formed axially therein spaced radially outwardly of the core 44. A second roll end holder generally indicated at 54 includes a same cylindrical engagement member 56, similar radial abutment surfaces 58, but the addition of a circumferential projection 60 located radially at and received axially in the roll annular groove 52. Thus, the roll of toweling 40 may be firmly mounted between the same first roll end holder 22 and the modified second roll end holder 54 with the first holder pins 30 in the roll pin holes 50 at the one roll end surface 48 and the cylindrical engagement member 56 in the core central opening 46, the second holder circumferential projection 60 incidentally being received in the roll groove 52 at the other roll end surface 48.

The combination of the roll annular groove 52 and the second holder circumferential projection 60 is from a portion of a prior automatic dismounting roll structure and is ineffective as to automatic roll dismounting according to the present invention. In other words, with the roll 40 retained at the one roll end surface 48 by the first holder pins 30 in the roll pin holes 50 and at the other roll end surface 48 by the second holder engagement member 56 in the core opening 46, roll dismounting will take place in the exact same manner as described above relative to the first embodiment, the second holder engagement member 56 eliminating any possible action as to roll dismounting by the combined roll annular groove 52 and second holder circumferential projection 60. The addition of this roll circumferential groove 52 and the second holder circumferential projection, however, adapts the roll 40 for reception in dispensers of other appropriate forms and automatic dismounting in such other dispensers, thereby adding versatility to the roll of toweling 40.

Figure 4:
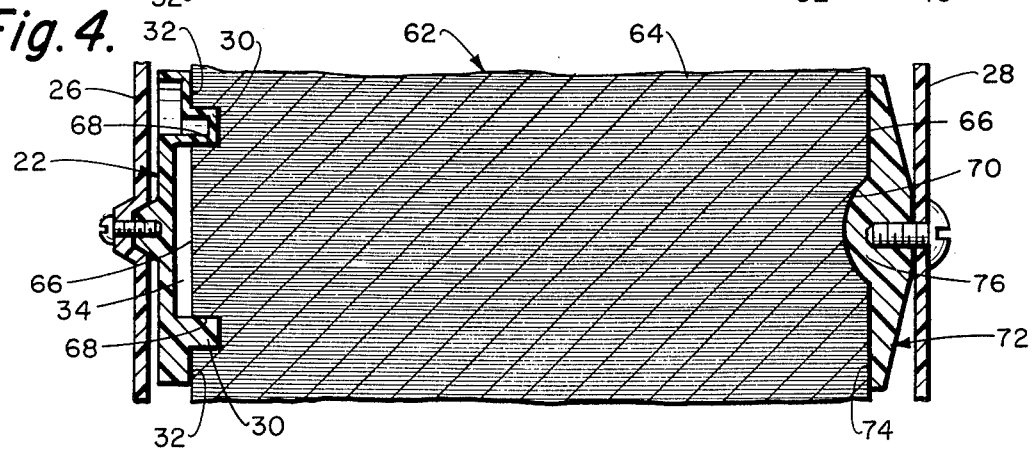
FIG. 4 is a view similar to FIGS. 2 and 3, but showing a third embodiment of a roll of toweling incorporating certain of the principles of the present invention.

In the third embodiment form incorporating the principles of the present invention as shown in FIG. 4, a roll of toweling generally indicated at 62 is a solid wound roll of toweling from a strip of toweling 64 so that there is no core, but still radial roll end surfaces 66. However, the roll 64 is still again formed with diametrically opposite pin holes 68 equally radially spaced from the central or main longitudinal axis of the roll 62 so as to be formed and located in precisely the same positions as in the first and second embodiments and effectively operable in the same manner with the pins 30 of the first roll end holder 22. At the other roll end surface 66, the roll 62 is formed with a central axial opening or hole 70 coaxial with the roll main longitudinal axis and in the preferred form, semi-spherical.

A second roll end holder generally indicated at 72 of this third embodiment form includes similar radial abutment surfaces 74 and a central, axial engagement member 76 semi-spherical in shape corresponding to the roll semi-spherical central opening 70. In view of the fact that the roll central opening 70 and the corresponding second holder engagement member 76 are of this semi-spherical shape, the radially outer extremities thereof are not of importance since that end of the roll 62 will be retained substantially until the strip of toweling 64 is at the roll main longitudinal axis, in other words, the automatic dismounting release of the roll 62 will still be solely determined by the roll pin holes 68 and the first holder pins 30 at the first roll end surface 66 as before. However, if the roll central opening 70 and the second holder engagement member 76 are formed corresponding cylindrical shapes, the outer extremities thereof would necessarily be not greater in radial dimension than the radially inner extremities of the roll pin holes 68 and the first holder pins 30, and preferably spaced radially inwardly therefrom, in order that the automatic roll dismounting will remain totally controlled by the roll pin holes and first holder pins at that roll end surface 66.

In any event, with the construction described, this third embodiment roll of toweling 62 will be securely retained between the first and second roll end holders 22 and 72 until a sufficient amount of the strip of toweling 64 is unrolled therefrom to reach the radially inner extremities of the roll pin holes 68. At this time, the first holder pins 30 will no longer be capable of supporting that end of the roll 62 permitting the same to drop by gravity through the clearance afforded by the first holder recess 34 and endwise pivoting about the second roll end holder 72. As in the other embodiments, the roll 62 will ultimately become disengaged from both of the first and second roll end holders 22 and 72 dropping downwardly and completing the automatic dismounting operation.

According to the principles of the present invention, therefore, in all three embodiments of the automatic dismounting rolls 10, 40 or 62, the rolls are very simply, but yet very securely retained by the cooperation of the roll pin holes 20, 50 or 68 and the roll central openings 14, 46 or 70 during the dispensing operation. Despite the simplicity and highly secure support, however, when the radially inner extremities of the roll pin holes 20, 50 or 68 are reached, the particular roll is efficiently automatically dismounted, all as hereinbefore described. Furthermore, by the addition of certain other roll structure forming a part of the automatic dismounting structure of prior roll constructions, it is possible to add versatility to the principles of the present invention so that the roll or rolls formed according to the present invention may be interchangeably used in the appropriate prior dispensers. Finally, with only very minor changes, the principles of the present invention are readily adapted to solid, strip wound rolls of toweling 62 which automatically dismount in the same efficient manner.

I claim:

1. In a roll of toweling adapted for automatic dismounting from roll end holders of a dispenser; the combination of: a continuously wound strip of toweling forming said roll having a central longitudinal axis; radially extending end surfaces on said roll; diametrically opposite and axially extending pin holes formed in one of said roll end surfaces, said pin holes having radially inner extremities equally radially spaced from said roll central longitudinal axis and radially outward of any core of said roll; end holder engagement means formed at the other of said roll end surfaces adapted for engagement by a roll end holder until said roll strip of toweling has been unwound to said radially inner extremities of said pin holes and said roll is being released at said one roll end surface.

2. In a roll of toweling as defined in claim 1 in which said end holder engagement means includes a central axial opening formed in said other roll end surface extending radially outwardly not greater than said pin hole radially inner extremities of said one roll end surface.

3. In a roll of toweling as defined in claim 1 in which said end holder engagement means includes a central axial cylindrical opening formed in said other roll end surface having outer radial extremities spaced radially inwardly of said radially inner extremities of said pin holes in said one roll end surface.

4. In a roll of toweling as defined in claim 1 in which said end holder engagement means includes a central axial semi-spherical opening formed in said other roll end surface.

5. In a roll of toweling as defined in claim 1 in which said end holder engagement means includes a central axial opening formed in said other roll end surface having radial extremities not greater than said radially inner extremities of said pin holes at said one roll end surface, a circumferentially extending axial groove formed in said other roll end surface spaced radially outwardly of said central axial opening.

6. In a roll of toweling adapted for automatic dismounting from roll end holders of a dispenser; the combination of: a strip of toweling continuously wound about a central core forming said roll, said core forming a roll central longitudinal axis; radially extending end surfaces on said roll; diametrically opposite and axially extending pin holes formed in one of said roll end surfaces having radially inner extremities radially outwardly of said roll core and equally radially spaced from said roll central longitudinal axis; end holder engagement means formed at the other of said roll end surfaces adapted for engagement by a roll end holder until said roll strip of toweling has been unwound to said radially inner extremities of said pin holes and said roll is being released at said one roll end surface.

7. In a roll of toweling as defined in claim 6 in which said end holder engagement means at said other roll end surface is formed in said central core.

8. In a roll of toweling as defined in claim 6 in which said roll central core is a hollow central core; and in which said end holder engagement means at said other roll end surface is formed by said roll hollow core.

9. In a method of formng a roll of toweling adapted for automatic dismounting from roll end holders of a dispenser, the steps of: continuously winding a strip of toweling to form said roll with a central longitudinal axis and radially extending end surfaces; forming axially extending pin holes at diametrically opposite positions in one of the roll end surfaces of said roll with radially inner extremities of said pin holes equally radially spaced from said roll central longitudinal axis and radially outward of any core of said roll; forming at least one engagement hole at the other of said roll end surfaces adapted for engagement by a roll end holder to hold said roll until said strip of toweling has been unwound to said radially inner extremities of said pin holes and said roll is being released at said one roll end surface.

10. In a method of forming a roll of toweling as defined in claim 9 in which said step of forming said at least one engagement hole at the other of said roll end surfaces includes forming said hole centrally of said other roll end surface having outer radial extremities not greater than said radially inner extremities of said pin holes in said one roll end surface.

11. In a method of forming a roll of toweling as defined in claim 9 in which said step of forming said at least one engagement hole at the other of said roll end surfaces includes forming a central engagement hole at said other roll end surface having outer radial extremities spaced inwardly of said radially inner extremities of said pin holes in said one roll end surface.

12. In a method of forming a roll of toweling as defined in claim 9 in which said step of forming said at least one engagement hole at the other of said roll end surfaces includes forming a central cylindrical hole at said other roll end surface having outer radial extremities spaced inwardly of said radially inner extremities of said pin holes in said one roll end surface.

13. In a method of forming a roll of toweling as defined in claim 9 in which said step of forming said at least one engagement hole at the other of said roll end surfaces includes forming a central semi-spherical hole at said other roll end surface.

14. In a method of forming a roll of toweling as defined in claim 9 in which said step of continuously winding a strip of toweling to form said roll includes continuously winding said strip of toweling about a central core; and in which said step of forming said at least one engagement hole at the other of said roll end surfaces includes forming said at least one engagement hole centrally in said roll core at said other roll end surface.

15. In a method of forming a roll of toweling as defined in claim 9 in which said step of continuously winding a strip of toweling to form said roll includes continuously winding said strip of toweling about a central hollow core; and in which said step of forming said at least one engagement hole at the other of said roll end surfaces includes forming said at least one engagement hole by an end of said central hollow core at said other roll end surface.

16. In a method of forming a roll of toweling as defined in claim 9 in which said step of forming said at least one engagement hole at the other of said roll end surfaces includes forming a central engagement hole at said other roll end surface, forming a circumferential groove in said other roll end surface spaced radially outwardly of said central hole.

17. In a method of forming a roll of toweling as defined in claim 9 in which said step of continuously winding a strip of toweling to form said roll includes continuously winding said strip of toweling about a central hollow core; and in which said step of forming said at least one engagement hole at the other of said roll end surfaces includes forming said at least one engagement hole by an end of said central hollow core at said other roll end surface, forming a circumferential groove in said other roll end surface spaced radially outwardly of said central hollow core.

* * * * *